US009662695B2

(12) United States Patent
Köstermeier

(10) Patent No.: US 9,662,695 B2
(45) Date of Patent: May 30, 2017

(54) METHOD AND DEVICE FOR ROLL-FORMING WORKPIECES

(71) Applicant: Repkon Machine and Tool Industry and Trade Inc., Istanbul (TR)

(72) Inventor: Karl-Heinz Köstermeier, Rheda-Wiedenbrück (DE)

(73) Assignee: Repkon Machine and Tool Industry and Trade Inc., Istanbul (TR)

( * ) Notice: Subject to any disclaimer, the term of this patent is extended or adjusted under 35 U.S.C. 154(b) by 0 days.

(21) Appl. No.: 14/384,845

(22) PCT Filed: Sep. 19, 2013

(86) PCT No.: PCT/EP2013/002824
§ 371 (c)(1),
(2) Date: Sep. 12, 2014

(87) PCT Pub. No.: WO2014/044396
PCT Pub. Date: Mar. 27, 2014

(65) Prior Publication Data

US 2015/0027190 A1 Jan. 29, 2015

(30) Foreign Application Priority Data

Sep. 22, 2012 (EP) ..... 12006680

(51) Int. Cl.
*B21B 17/02* (2006.01)
*B21D 22/16* (2006.01)

(52) U.S. Cl.
CPC ..... *B21B 17/02* (2013.01); *B21D 22/16* (2013.01)

(58) Field of Classification Search
CPC ..... B21D 22/14; B21D 22/16; B21D 22/18; B21D 22/185; B21D 39/08; B21D 39/20;
(Continued)

(56) References Cited

U.S. PATENT DOCUMENTS 4,766,752 A * 8/1988 Gronert ..... B21D 22/14 72/110
2008/0314113 A1 12/2008 Minoguchi
(Continued)

FOREIGN PATENT DOCUMENTS

DE 4140948 6/1993

OTHER PUBLICATIONS

International Search Report in PCT Application PCT/EP2013/002824, EOP, Oct. 10, 2013.
(Continued)

*Primary Examiner* — Teresa M Ekiert

(57) ABSTRACT

A method for producing workpieces wherein a substantially rotationally symmetrical workpiece (4, 9, 33), which has a workpiece axis (22), is tentered concentrically relative to an inner mandrel (3, 16) provided inside the workpiece (4, 9, 33), and is reshaped by a process of flow forming by radially applying external reshaping rollers (7). The wall thickness of the workpiece (4) is also reduced in at least some regions. The inner diameter (18, 41) of the workpiece (33) is enlarged by applying inner reshaping rollers (11) of an inner reshaping unit. The inner reshaping rollers (11) are arranged such that the roller axes of rotation and the enveloping cone (20) all intersect at one point on the workpiece axis (22).

7 Claims, 8 Drawing Sheets

(58) Field of Classification Search
CPC ..... B21D 22/00; B21B 17/02; B21B 19/00; B21B 19/14; B21C 37/15; B21C 37/16; B21C 37/26
See application file for complete search history.

(56) References Cited

U.S. PATENT DOCUMENTS

| | | | | |
|---|---|---|---|---|
| 2010/0236122 | A1 | 9/2010 | Fonte | |
| 2012/0090372 | A1* | 4/2012 | Nillies | B21D 22/16 72/85 |

OTHER PUBLICATIONS

Translated International Preliminary Report on Patentability in PCT Application PCT/EP2013/002824, EPO, Mar. 24, 2015.

* cited by examiner

METHOD AND DEVICE FOR ROLL-FORMING WORKPIECES

TECHNICAL FIELD

The invention relates to a method to reshape a workpiece and more particularly, to an apparatus and method to reshape a workpiece that utilizes an interior-shaping unit with or without an exterior-shaping unit acting on a driven workpiece, wherein the inner shaping unit rollers and, if provided, the adjacent outer rollers of the exterior shaping unit possess a minimum tangential separation from one another, thus allowing maximizing of the reshaping rollers about the circumference of the contact diameter of the workpiece.

BACKGROUND INFORMATION

As shown schematically in FIG. 1 (cross-sectional view) and FIG. 2 (longitudinal-sectional view), methods are known in which a workpiece 4 is displaced by rotation along one rotational direction 6, and then is reshaped by means of a cylinder or roller 2 acting on the workpiece from an external position and mounted within a bearing housing 1 at relative displacement from the workpiece 4 along an axial-displacement direction 5 with respect to the reshaping roller 2. In most cases, this reshaping occurs in a manner such that the outer reshaping rollers 2 press the material of the workpiece 4 in the area to be reshaped against a mandrel 3 so that the material is partially displaced axially, radially, and tangentially in a fluid condition, and this leads to a reduction in wall thickness of the workpiece 4, whereby the reduced wall thickness to be achieved results from the separation between the reshaping roller 2 and the mandrel 3.

For this, the potential reduction in wall thickness of the workpiece 4 is limited by the value of wall thickness, the stiffness of the material, the friction between the inner walls of the blank mold 4 and the mandrel 3, and the potential number of reshaping rollers 2 at the circumference of the workpiece 4.

The causes for this limitation is:

The magnitude of force that may be partially introduced into the workpiece by means of the reshaping roller 2, generating a yield stress there;

The stiffness of the material, which cannot be influenced by the reshaping process;

The magnitude of friction between the workpiece 4 and the mandrel 3, which is dictated by the type of process;

The number of reshaping rollers 2 that may be mounted about the circumference of the workpiece 4; and The dimensions of the mounting of the reshaping rollers 2, which in turn are determined by the service life of the bearing and its dimensions, as well as the size of the reshaping rollers 2.

Also, the effect of the contact-pressure force of the reshaping rollers 2 is reduced as the wall thickness to be reshaped increases, so that it is no longer possible after a certain wall thickness to bring the material in the pressure areas 7 (effective area) of the reshaping rollers 2 into a fluid condition. Thus, the thickness of the walls to be reduced using known pressure-roller processes is limited by the lacking yield stress of the material.

SUMMARY OF THE INVENTION

It is the task of the invention to provide a method and a device with which the shaping of a rotation-symmetrical workpiece with constant or varying wall thickness is possible even for greater wall thicknesses.

The task is solved by a method with the steps and properties disclosed herein, and by a device with the properties disclosed and described herein.

Based on the invention, it is provided that the inner diameter of the workpiece be expanded by the pressure of inner reshaping rollers of an interior-shaping unit, and/or the outer diameter be reduced by the pressure of the outer reshaping rollers. Particularly, the inner mandrel may be displaced by the interior-shaping unit even in the above-mentioned processes. The described contact pressure can exert pressure on the wall of the workpiece from both the inside and outside, and fluidity is ensured even for thicker walls. For this, the inner reshaping rollers are shaped such that the enveloping surface of each of the running surfaces of the inner reshaping rollers defines a truncated-cone shell. Each of the pertinent cones includes a cone tip. Based on the invention, all of these tips lie on the rotation axes of the inner reshaping rollers. Further, the inner reshaping rollers are positioned such that their roller rotational axes all intersect at one point along the rotational axis of the workpiece whereby the points defined by the cone tips also lie at this common intersection point. Thus, the mandrel may be driven with the workpiece about the workpiece axis. Alternatively, both the inner and/or outer reshaping rollers may be driven in rotation. The same geometry with the same common intersection point as described for the inner reshaping rollers may alternatively or additionally be provided for the outer reshaping rollers.

The method based on the invention achieves the fact that the yield stress in the reshaping area in the walls of the workpiece is increased by means of interior-shaping units and exterior-shaping units acting on a driven workpiece in that the inner rollers and the adjacent outer rollers possess a minimum tangential separation from one another, thus allowing maximizing of the reshaping rollers about the circumference of the contact diameter of the workpiece. This may be achieved by driven interior- and exterior-shaping units acting on a fixed workpiece.

BRIEF DESCRIPTION OF THE DRAWINGS

In the following, the invention will be described in greater detail using FIGS. 1 through 8, which show.

DETAILED DESCRIPTION OF THE PREFERRED EMBODIMENT

Figure 1:
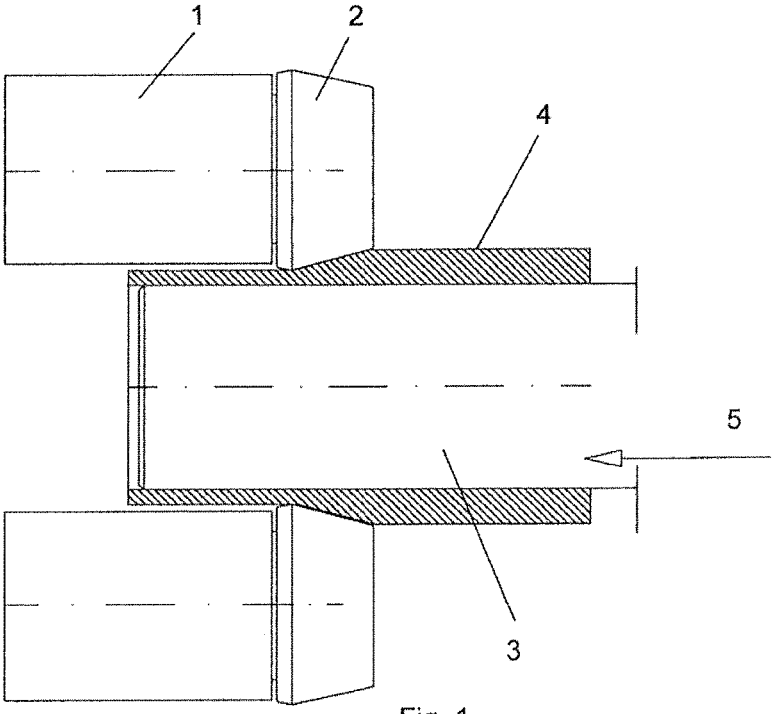
Fig. 1 PRIOR ART
FIG. 1 is a schematic longitudinal cutaway view of a device according to the prior art.
Figure 2:
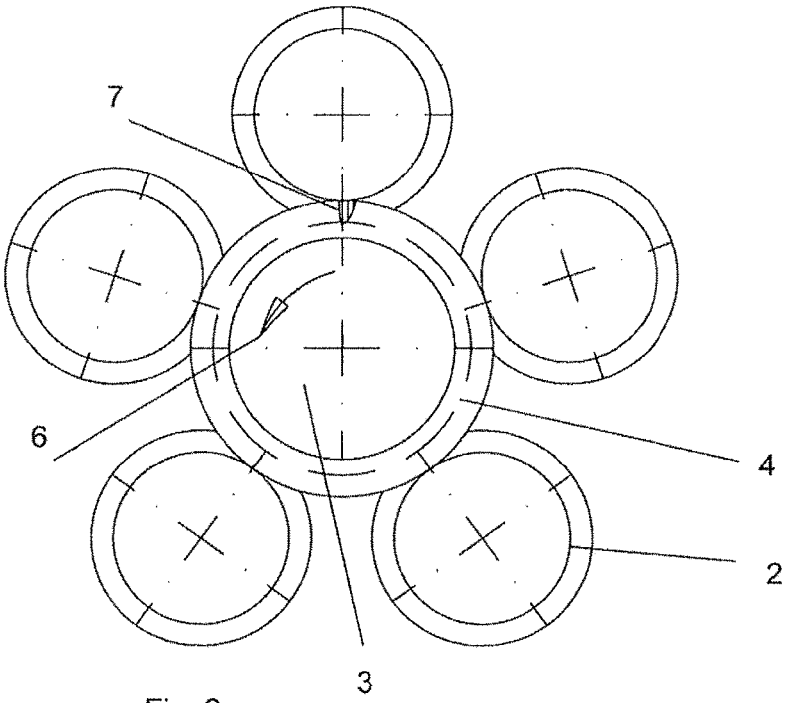
Fig. 2 PRIOR ART
FIG. 2 is a schematic cross-sectional view illustrating the effective areas of the reshaping rollers in a device as per the prior art.
Figure 3:
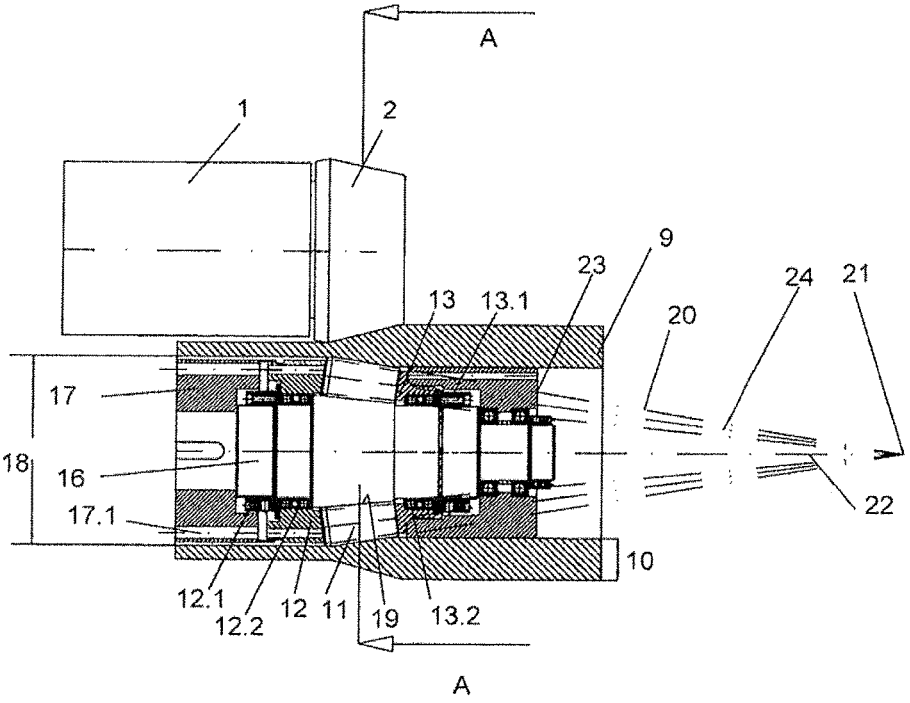
FIG. 3 is a longitudinal cutaway view of a part of a device according to a first embodiment of the invention.
Figure 4:
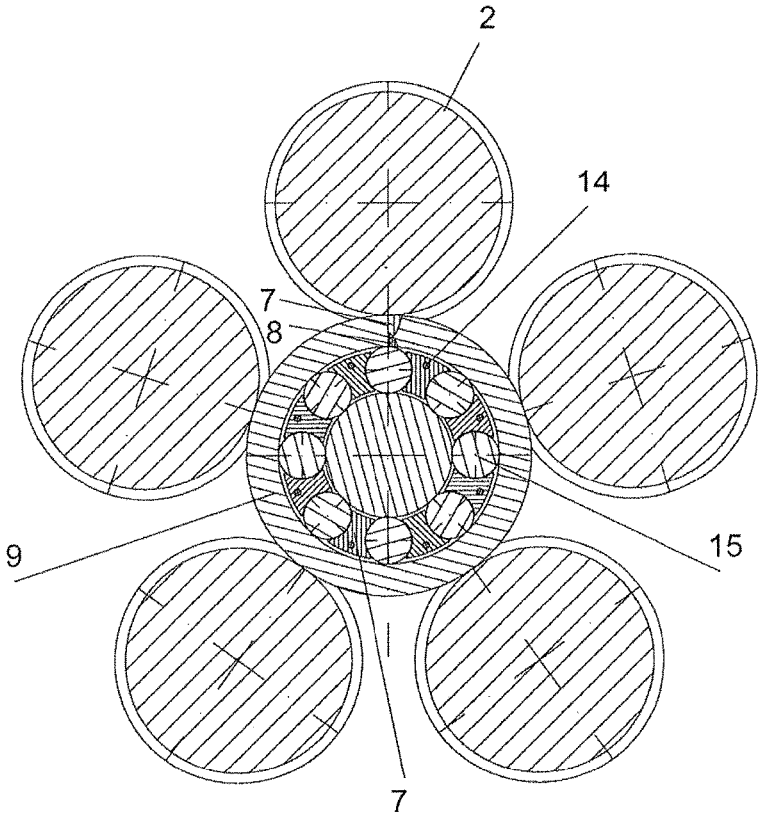
FIG. 4 is a cross-sectional view of the device part shown in FIG. 3 along lines A-A.
Figure 5:
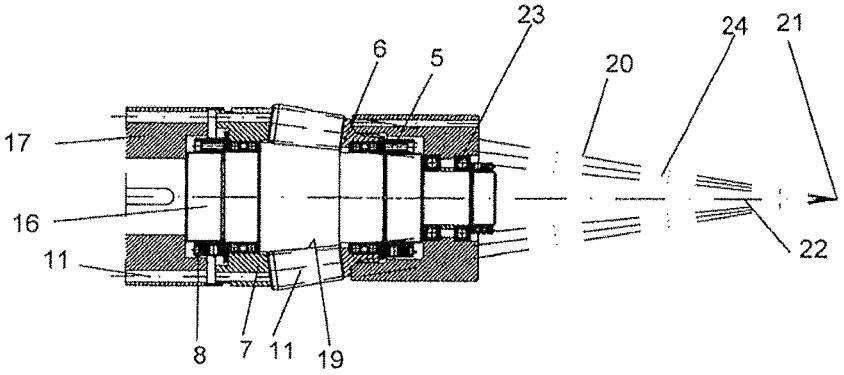
FIG. 5 is a longitudinal cutaway view of the inner mandrel with inner reshaping rollers according to the invention.

FIGS. 3 through 5 show a first embodiment of the invention. The exterior-shaping unit in this embodiment example is implemented by the outer reshaping rollers 2 shown in FIGS. 1 and 2. In order to enlarge the pressure area 7 (see FIG. 4) in the depth of the workpiece walls based on the invention, an interior-shaping unit (shown in FIGS. 5 and 6) is used instead of the simple mandrel used in the prior art as shown in FIG. 1. This interior-shaping unit provides an additional pressure area 8 against the interior of the workpiece 9 by the contact pressure of the inner reshaping rollers, said area 8 extending radially outward from the interior of the workpiece 9. This is shown in FIG. 4. Two pressure areas 7, 8 that overlap each other are formed by the shaping units on both sides, thus significantly increasing the available reduction potential of the wall thickness 10, or permitting a higher degree of stiffness of the material to be reshaped with a constant reduction in wall thickness.

In the illustrated example, this interior-shaping unit based on the invention includes a number of conic rollers tangential to the workpiece 9 that may be mounted as reshaping rollers 11 particularly in a cage 12, 13 that may be repositioned tangentially and axially with respect to the workpiece 9. The cage is held together using threaded fasteners 14, and may be adjusted axially. The reshaping rollers 11 rest against an inner mandrel 16 that is particularly conic and that is secured to an extension section 17 whose diameter is smaller than the shaped inner workpiece diameter 18, or smaller than the inner workpiece diameter 18 to be shaped.

The reshaping rollers 11 are thus particularly held in position tangentially and axially by the cage 12, 13, and radially by the inner mandrel 16. This arrangement ensures that the reshaping rollers do not fall out of the interior-shaping unit when the interior-shaping unit is located outside of the workpiece 9. Because of design and configuration of these reshaping rollers 11, a maximum number of reshaping rollers is possible that exert the maximum possible reshaping force on the inner walls of the workpiece with minimum tangential separation from one another.

A conic outer enveloping surface 20 is formed by means of the rolling action of the reshaping rollers 11 with the conic exterior (conic exterior means that at least the enveloping surface of the inner or outer reshaping roller is truncated-cone or cone-shaped) on the exterior 19 of the inner mandrel 16. The larger diameter of this enveloping surface determines the shapeable inner diameter 18 of the workpiece 9.

The midlines of the centers of conical reshaping rollers 11 intersect with the tips of the enveloping surfaces of all conical reshaping rollers 11 at a point 21 that lies along the workpiece axis and/or the rotational axis 22 of the workpiece 9. Axial displacement capability of the cage 12, 13 allows radial adjustability of the reshaping rollers to a diameter at which the midlines 24 and the ends of the enveloping surfaces 20 of the reshaping rollers 11 intersect with the rotational axis 22 of the workpiece 9 at a point 21, and their speeds are thus matched. During the reshaping, the greater diameter of the conical enveloping surface 20 forms the inner diameter 18 of the shaped workpiece 9.

An inner centering unit 23 may be provided for the area of the workpiece to be shaped, and an additional inner centering unit (not shown) may be provided for the shaped area of the workpiece. Both centering units are mounted independently of each other in the center of the rotational axis so that they may be forced through the workpiece 9 during the reshaping process with minimum frictional loss.

One interior-shaping unit (FIG. 3) per exterior-shaping unit may be used on a workpiece. For this, it does not matter whether the workpiece is driven or the shaping units are driven, since the effect on the shaping process is the same.

The interior-shaping unit may also be used without an exterior-shaping unit. In such case, an outer sheath (not shown) must be mounted in the area of the reshaping that is driven axially and tangentially by flowing material so that only minimal friction may arise between the material and the inner walls of the outer sheath.

Figure 6:
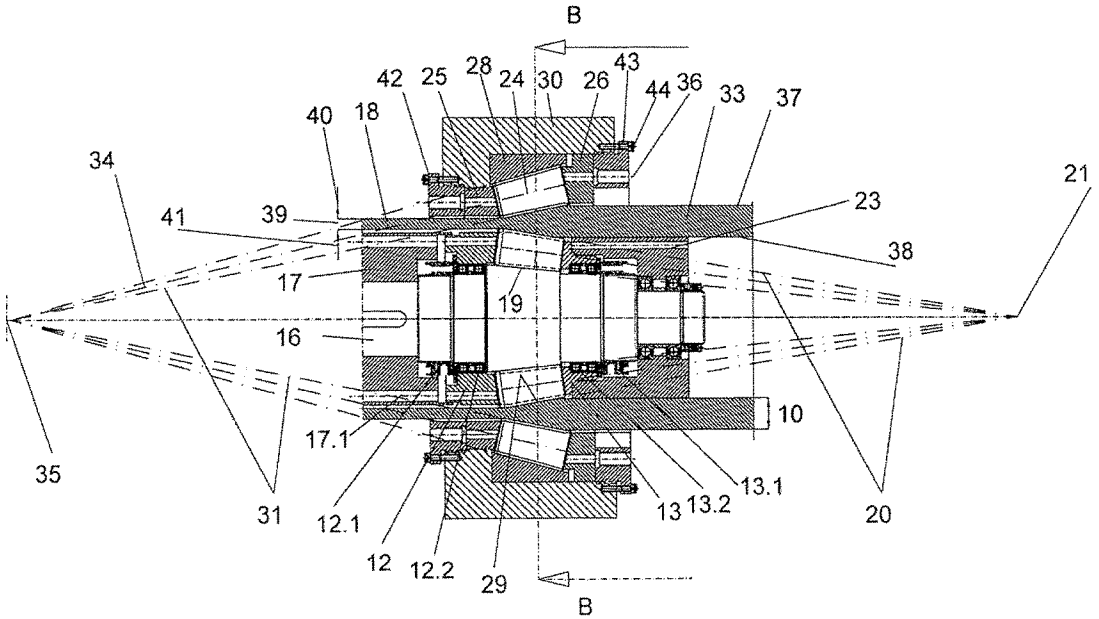
FIG. 6 is a longitudinal cutaway view of a part of a device according to a second embodiment of the invention.
Figure 7:
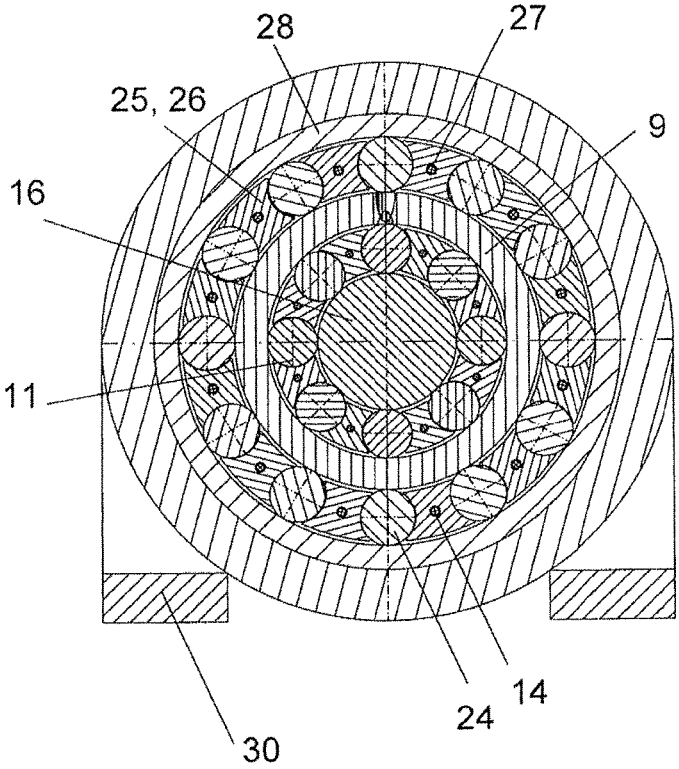
FIG. 7 is a cross-sectional view of the device part shown in FIG. 6 along lines B-B.
Figure 8:
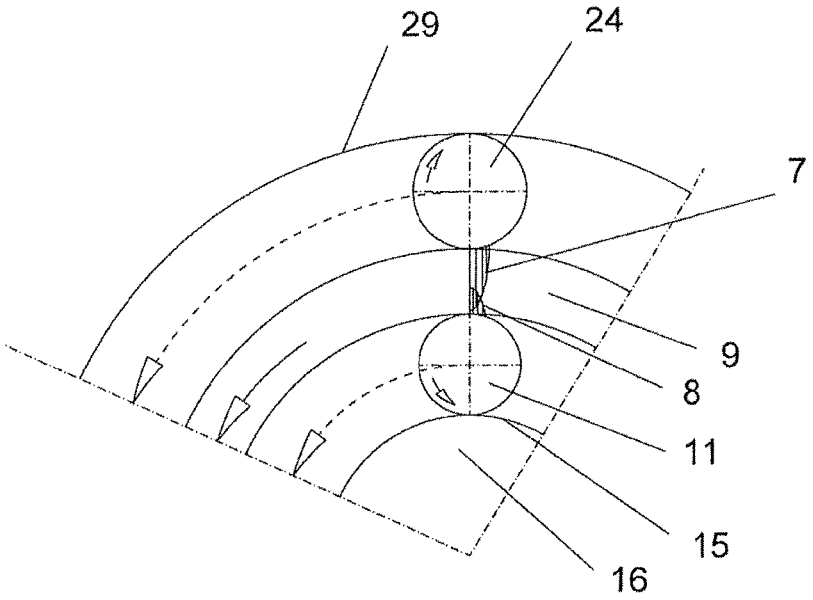
FIG. 8 is a schematic cross-sectional view illustrating the effective areas of the reshaping rollers in a device according to the invention.

In order more greatly to increase the pressure areas into the depth of the workpiece walls, a modified exterior-shaping unit based on the invention may be provided, as shown in FIGS. 6 through 8. The interior-shaping unit shown there corresponds to the embodiment example described previously.

The illustrated exterior-shaping unit possesses a number of conical rollers tangential to the workpiece that are provided in the illustrated example in a cage 25, 26 whose left and right cage parts are connected together by threaded fasteners 27, and which can be axially adjustable. The configuration, shape, and orientation of the exterior reshaping rollers 24 are very similar to that of the inner reshaping rollers 11 described above.

A bearing race 28 with inner running surface 29 facing the reshaping rollers 24 mounted in an outer housing 30 is provided to support the outer slide way of the reshaping rollers 24. The outer reshaping rollers 24 are thus held tangentially and axially in position by means of a cage 25, 26, and radially by the outer bearing race 28. Because of this configuration, the reshaping rollers 24 with their inner slide ways form a conical enveloping body 31 whose angle to the rotational axis 32 of the workpiece 33 corresponds to the approach angle of a reshaping roller 24.

By means of the radial displacement capability of the axially-assembled cage 25, 26, the adjustability of the reshaping rollers 24 is possible to a diameter at which the midlines 34 and the ends of the enveloping body 31 of the conical rollers 24 intersect at one point with the rotational axis of the workpiece 33, and are thus matched to each other regarding speed. During reshaping, the small diameter of the truncated-cone-shaped enveloping bodies of the reshaping rollers 24 thus forms the outer diameter of the shaped workpiece. Simultaneously, the cage configuration prevents the reshaping rollers from falling out when no workpiece 33 is located within the interior of the exterior-shaping unit.

This configuration of the outer reshaping rollers 24 allows a maximum number of reshaping rollers with minimum tangential separation from one another that exert the maximum possible reshaping force on the outer wall of the workpiece, and that are supported by rolling on the conical inner side 29 of the outer bearing race 28. All reshaping rollers 29 together form a conical enveloping body 31 within the cage 25, 26 whose angles to the rotational axis 22 of the workpiece 33 form the approach angle of the reshaping rollers 24 to reshape the workpiece 33. As soon as the rotating workpiece 33 axially meets the inner enveloping bodies 31 of the reshaping rollers 24, these [enveloping bodies 31] rotate, thereby rolling over the fixed inner conical bearing race 29 of the outer ring 28. Because of the axial pressure of the advancement along the axial direction, and of the torque of the workpiece 33, an axial, tangential, and radial force is generated that places the material into a plastic state so that it flows, causing the reshaping process to begin. During this reshaping, the reshaping rollers are preferably rinsed with a lubricating coolant liquid that is supplied via the coolant connection 36.

A similar reshaping process is possible with the reshaping unit described above if the outer bearing race 28 is tangentially and axially driven, and the workpiece 33 is fixed, or when only the outer bearing race 28 is driven tangentially and the workpiece 33 is tangentially fixed and axially displaced.

With a fixed workpiece 33, it is also possible to mount a driven reshaping unit on each end of the workpiece 33 in order simultaneously to start an independent process on both sides, each with its own dimensions.

If no interior-shaping unit is present, an inner mandrel 3 to accept the workpiece 33 is required for the two types of exterior-shaping units onto which the workpiece is reshaped while centered. The shape of the mandrel can have considerable influence on the friction between the workpiece and flowing material. Using a mandrel driven by the material flow or using an inner roller can achieve minimum frictional losses between material and mandrel.

Further, there exists the option of mounting an interior-shaping unit in combination with a mandrel within the interior of the driven workpiece, and mounting one or more exterior-shaping units about the circumference of the workpiece, whereby the exterior-shaping unit then reshapes axially at the same workpiece cross section and simultaneously another exterior-shaping unit in the area of the mandrel reshapes another part of the workpiece.

Accordingly, the invention achieves the fact that the yield stress in the reshaping area in the walls of the workpiece is increased by means of an interior-shaping unit with or without an exterior-shaping unit acting on a driven workpiece, wherein the inner rollers and the adjacent outer rollers possess a minimum tangential separation from one another, thus allowing maximizing of the reshaping rollers about the circumference of the contact diameter of the workpiece. This is achieved by driven interior- and potentially exterior-shaping units acting on a fixed workpiece.

Modifications and substitutions by one of ordinary skill in the art are considered to be within the scope of the present invention, which is not to be limited except by the following claims.

The invention claimed is:

1. A method of reshaping a workpiece in which an essentially rotation-symmetrical workpiece (4, 9, 33) having a workpiece axis (22) is tensioned concentrically by an inner mandrel (3, 16) provided within the workpiece (4, 9, 33) and is reshaped by pressure cylinders by radial pressure from a plurality of inner reshaping rollers (11) or the plurality of inner reshaping rollers (11) and a plurality of outer reshaping rollers (24), whereby one or more of the inner mandrel (3, 16), the workpiece (4, 9, 33), the plurality of inner reshaping rollers (11), and the plurality of outer reshaping rollers (24) are configured for being rotationally driven, and whereby the wall thickness of the workpiece (4, 9, 33) is reduced at least in sections of the workpiece (4, 9, 33), the method comprising the steps of:

providing a plurality of inner reshaping rollers (11) as part of an interior-shaping unit, whereby the plurality of inner reshaping rollers (11) are disposed tangentially to said workpiece axis (22) and together said plurality of inner reshaping rollers (11) form an inner reshaping roller envelope defining a shell truncated cone (20), and wherein a tip of said shell truncated cone (20) lies on a rotational axis (22) of the workpiece axis (22), whereby the plurality of inner reshaping rollers (11) are furthermore mounted such that their roller rotational axes and the shell truncated cones (20) all intersect at a point (21) along the workpiece axis (22) exterior of said interior-shaping unit in a first axial direction;

providing a plurality of outer reshaping rollers (24) as part of an exterior-shaping unit, whereby the plurality of outer reshaping rollers (24) are disposed tangentially to said workpiece axis (22) and together form an outer reshaping roller envelope defining a truncated-cone shell (31) about the rotational axis (34) of the outer reshaping rollers (24), and wherein a tip (35) of each truncated-cone shell (31) lies on the workpiece rotational axis (22), and whereby the plurality of outer reshaping rollers (24) are further mounted such that their roller rotational axes (34) and the shell cone (31) all intersect at a single point (35) along the workpiece axis (22) exterior of said interior-shaping unit in a second axial direction opposite from said first axial direction; and expanding an inner diameter (18, 41) of the workpiece (4, 9, 33) by exerting contact pressure against the inner diameter (18, 41) of the workpiece (4, 9, 33) by said plurality of inner reshaping rollers (11) of said interior-shaping unit while simultaneously reducing an outer diameter of the workpiece by the plurality of outer-reshaping rollers (24) by applying contact pressure from the plurality of outer reshaping rollers (24) of the exterior-shaping unit against the workpiece (4, 9, 33) and expanding the inner diameter of the workpiece (4, 9, 33) by the interior-shaping unit (7, 23), whereby the exterior and interior shaping units are positioned such that individual contact-pressure areas of the plurality of outer reshaping rollers (24) against an outer surface of the workpiece (4, 9, 33) axially overlap contact areas of the plurality of inner reshaping rollers (11) against an inner surface of the workpiece (4, 9, 33) with respect to the workpiece axis (22).

2. The method of claim 1, wherein each of the interior and exterior shaping units is driven axially and tangentially by its own drive with respect to the longitudinal workpiece axis (22), whereby the workpiece (4, 9, 33) is fixed and under tension.

3. The method of claim 1, further including providing a plurality of exterior-shaping units to reduce an outer diameter of the workpiece (4, 9, 33), and a plurality of interior-shaping units configured to simultaneously expand an inner diameter of the workpiece (4, 9, 33).

4. A device to reshape a workpiece, said device comprising:

an inner mandrel (3, 16) about which an essentially rotation-symmetrical workpiece (4, 9, 33) with a workpiece axis (22) may be mounted concentrically;

an interior-shaping unit including a plurality of inner reshaping rollers (11) configured to expand an inner diameter (18, 41) of the workpiece (4, 9, 33), whereby the plurality of inner reshaping rollers (11) are disposed tangentially to said workpiece axis (22) and together said plurality of inner reshaping rollers (11) form an inner reshaping roller envelope defining a truncated-cone shell, and wherein a tip of each truncated cone shell lies on said workpiece (4, 9, 33), whereby the plurality of inner reshaping rollers (11) are furthermore mounted such that their roller rotational axes and the truncated cone shell (20) all intersect at a single point (21) along said workpiece axis (22) at a point exterior of said interior-shaping unit in a first axial direction, an exterior-shaping unit including a plurality of outer reshaping rollers (24), whereby the plurality of outer reshaping rollers (24) are disposed tangentially to said workpiece axis (22) and together form an outer reshaping roller envelope defining a truncated-cone shell (31) about the rotational axis (34) of the plurality of outer reshaping rollers (24), and wherein a tip (35) of each truncated-cone shell (31) lies on the workpiece rotational axis (22), and whereby the plurality of outer reshaping rollers (24) are further mounted such that their roller rotational axes (34) and the shell cone (31) all intersect at a single point (35) along the workpiece axis (22) at a point exterior of said interior-shaping unit in a second axial direction opposite from said first axial direction; and whereby the inner mandrel (3, 16) along with the workpiece (4, 9, 33) is configured to be driven about the workpiece axis (22) and about the plurality of inner reshaping rollers and one or more outer reshaping rollers.

5. The device according to claim 4, characterized in that the plurality of outer and inner reshaping rollers include a number of profiled shapes.

6. The device according to claim 4, characterized in that each of the interior and exterior shaping units possesses its own axial and tangential drive with respect to the workpiece axis (22).

7. The device according to claim 4, characterized in that the device includes a number of exterior-shaping units and a number of interior-shaping units.

* * * * *